US006946669B2

(12) United States Patent
Kleinschmidt

(10) Patent No.: US 6,946,669 B2
(45) Date of Patent: Sep. 20, 2005

(54) ARRANGEMENT FOR THE GENERATION OF EUV RADIATION WITH HIGH REPETITION RATES

(75) Inventor: Juergen Kleinschmidt, Weissenfels (DE)

(73) Assignee: XTREME technologies GmbH, Jena (DE)

( * ) Notice: Subject to any disclaimer, the term of this patent is extended or adjusted under 35 U.S.C. 154(b) by 111 days.

(21) Appl. No.: 10/772,910

(22) Filed: Feb. 5, 2004

(65) Prior Publication Data

US 2004/0155207 A1 Aug. 12, 2004

(30) Foreign Application Priority Data

Feb. 7, 2003 (DE) ..... 103 05 701

(51) Int. Cl.[7] ..... G21J 1/00; G21K 5/00
(52) U.S. Cl. ..... 250/504 R; 250/492.2
(58) Field of Search ..... 250/504, 492.2

(56) References Cited

U.S. PATENT DOCUMENTS

| | | | | |
|---|---|---|---|---|
| 6,396,068 | B1 * | 5/2002 | Sweatt et al. | 250/504 R |
| 2002/0001363 | A1 | 1/2002 | Kondo | |
| 2003/0223544 | A1 * | 12/2003 | Murakami | 378/119 |
| 2004/0129895 | A1 * | 7/2004 | Goldstein et al. | 250/492.2 |

FOREIGN PATENT DOCUMENTS

| | | |
|---|---|---|
| EP | 1 298 965 | 4/2003 |
| EP | 1 319 988 | 6/2003 |
| WO | WO 01/91523 | 11/2001 |

* cited by examiner

*Primary Examiner*—John R. Lee
*Assistant Examiner*—James J. Leybourne
(74) *Attorney, Agent, or Firm*—Reed Smith LLP

(57) ABSTRACT

The arrangement for generating EUV radiation based on electrically triggered gas discharges with high repetition rates and high average outputs. The object of the invention, to find a novel possibility for generating EUV radiation based on a gas discharge pumped plasma which permits the generation of EUV pulse sequences with a pulse repetition frequency of greater than 5 kHz at pulse energies of at least 10 mJ/sr without having to tolerate increased electrode wear, is met according to the invention in that a plurality of source modules of identical construction, each of which generates a radiation-emitting plasma and has bundled EUV radiation, are arranged in a vacuum chamber so as to be uniformly distributed around an optical axis of the source in its entirety in order to provide successive radiation pulses at a point on the optical axis, so that a reflector device which is supported so as to be rotatable around the optical axis deflects the radiation delivered by the source modules in the direction of the optical axis successively with respect to time. A synchronization device triggers the source modules in a circularly successive manner depending upon the actual rotational position of the reflector device and adjusts a preselected pulse repetition frequency by means of the rotating speed.

16 Claims, 4 Drawing Sheets

ARRANGEMENT FOR THE GENERATION OF EUV RADIATION WITH HIGH REPETITION RATES

CROSS-REFERENCE TO RELATED APPLICATION

This application claims priority of German Application No. 103 05 701.3, filed Feb. 7, 2003, the complete disclosure of which is hereby incorporated by reference.

BACKGROUND OF THE INVENTION a) Field of the Invention

The invention is directed to an arrangement for generating EUV radiation based on electrically triggered gas discharges in which a vacuum chamber is provided for the generation of radiation, which vacuum chamber has an optical axis for the generated EUV radiation as it exits the vacuum chamber, with high repetition rates and high average outputs, preferably for the wavelength region of 13.5 nm.

b) Description of the Related Art

Sources for EUV radiation or soft X-ray radiation are promising radiation sources for the next generation in semiconductor lithography. Radiation sources of this kind which work in pulsed operation can generate radiation-emitting plasma in different ways based on laser excitation or on an electrically triggered gas discharge. The present invention is directed to the latter.

Structure widths between 25 and 50 nm are generated with EUV radiation (chiefly in the wavelength range of 13.5 nm). In order to achieve a sufficiently high throughput of wafers per hour in semiconductor lithography, in-band radiation outputs of 600 W to 700 W in a solid angle of $2\pi \cdot sr$ are specified for the EUV sources to be used. "In-band" radiation output designates the spectral component of the total emitted radiation which can be processed by the imaging optics.

A characteristic variable for an EUV source is conversion efficiency, which is defined as the quotient of EUV in-band output (in $2\pi \cdot sr$) and the electrical power dissipated in the discharge system. It is typically around 1 to 2%. This means that electrical outputs of about 50 kW are used in the electrode system for the generation of gas discharge. This results in extremely high heating of the electrodes.

Empirical findings show that the life of the electrodes is limited by two effects:

a) electrode consumption due to the current flow ($I_{max} \approx 30$–50 kA, duration≈500 ns) during the discharge process. Local overheating and evaporation take place in a very thin surface layer.

b) electrode consumption due to melting and evaporation of the electrode material at high average input powers.

The first effect a) represents a limit in principle. This effect can be reduced only by using electrode materials with the lowest sputter tendency (sputter rates) and/or by reducing the current density through selection of suitable electrode geometries. Effect b) is usually reduced by good cooling.

However, at high pulse repetition frequencies, i.e., at high repetition rates of the EUV source, another aspect must be taken into consideration.

According to effect a), the electrode surface is highly heated during an excitation pulse (see also FIG. 1). Because of the finite thickness (e.g., 5 mm) of the tungsten layer of the electrodes and the finite speed of the heat flow to the actual heatsink (the cooling time is around 10 $\mu$s depending on the material and geometry of the electrode), the next discharge already takes place before the electrode surface has reached the coolant temperature again. Therefore, the electrode surface is heated again during a series of discharges. Estimates show that the surface temperatures of the electrodes would be permanently (and not just periodically at every individual discharge) above the melting temperature for input-side pulse energies of 10 J at repetition rates of more than 5 kHz (continuous operation). In practice, this means that continuous operation of a gas discharge pumped EUV source for repetition rates of more than 5 kHz is impossible. A test for reducing electrode erosion was carried out by M. W. McGeoch. WO 01/91523 A1 describes a photon source in which a large number of particle beams are generated so as to be distributed over spherical electrode surfaces in such a way that they meet at a point referred to as the discharge zone. The ion beams generated in a vacuum chamber are accelerated toward the center of the discharge zone and partially discharged by means of concentric (cylindrical or spherical) electrode arrangements with circular openings resulting in a linear acceleration channel for every ion beam. In this way, a dense, hot plasma generating EUV radiation or soft X-ray radiation is formed in the center of the arrangement.

A disadvantage consists in that the adjustment for exact centering is complex and the plasma generated in this way is characterized by rather strong fluctuations of the center of gravity.

OBJECT AND SUMMARY OF THE INVENTION

It is the primary object of the invention to find a novel possibility for generating EUV radiation based on a gas discharge pumped plasma which permits the generation of EUV pulse sequences with a repetition rate greater than 5 kHz at pulse energies greater than or equal to 10 mJ/sr without having to tolerate increased electrode wear.

In an arrangement for generating EUV radiation based on electrically triggered gas discharges in which a vacuum chamber is provided for the generation of radiation, which vacuum chamber has an axis of symmetry representing an optical axis for the generated EUV radiation upon exiting the vacuum chamber, the above-stated object is met according to the invention in that a plurality of source modules of identical construction, each of which generates a radiation-emitting plasma and has bundled EUV radiation, are arranged in the vacuum chamber so as to be uniformly distributed around the optical axis in order to provide successive radiation pulses, wherein the bundled beams of the individual source modules have beam axes which intersect at a point on the optical axis, in that there is a reflector device which is supported so as to be rotatable about the optical axis and which deflects the bundled radiation delivered by the source modules in the direction of the optical axis successively with respect to time, and in that a synchronization device is provided for circularly successive triggering of the source modules depending upon the actual rotational position of the reflector device and upon the pulse repetition frequency which is preselected by means of the rotating speed.

The reflector device advantageously has a plane mirror as rotating reflecting optical component. In a particularly advisable variant, the rotating reflecting component is an optical grating which is preferably spectrally selective for the desired bandwidth of the EUV radiation that can be transmitted by subsequent optics. The rotating reflector device is advisably cooled in a suitable manner.

The source modules can comprise any conventional EUV sources (e.g., z-pinch, theta-pinch, plasma focus or hollow cathode arrangements) and each has a separate high-voltage charging circuit. However, the individual source modules advantageously have a common high-voltage charging module which is triggered by the synchronization device and successively triggers the gas discharge in the individual source modules. The synchronization device can be coupled directly with the rotating mechanism (e.g., incremental encoder) in a simple manner.

The synchronization device advantageously has, per source module, a position-sensitive detector which is struck by a laser beam reflected by the reflector device when reaching a rotational position of the reflector device suitable for triggering a gas discharge pulse of a source module. In an advisable variant, the synchronization device comprises a laser beam which is coupled in along the optical axis in the direction opposite to the generated EUV radiation and is reflected at the reflector device and, for each source module, triggers an associated detector which initiates the gas discharge for the associated source module. In another construction, the synchronization device has, for each source module, an associated laser beam and a position-sensitive detector.

The source modules advantageously comprise an EUV source, debris filter and collector optics. Every source module preferably has an EUV source with accompanying high-voltage charging circuit. However, it may be advisable that all source modules share a common high-voltage charging module which successively triggers the gas discharge depending upon the triggering derived from the rotational position of the reflector device.

In another advantageous design, the source modules each comprise an EUV source and an optics unit outfitted with a debris filter and collecting optics. Collector optics which are shared by all of the source modules are arranged downstream of the reflector device on the optical axis.

The arrangement according to the invention advisably has source modules in a quantity such that the pulse frequency of each individual source module resulting with successive control of the source modules is not higher than 1500 Hz.

With the solution according to the invention it is possible to generate EUV radiation based on a gas discharge pumped plasma in which the EUV pulse sequences can be generated with a repetition rate of greater than 5 kHz at pulse energies of greater than or equal to 10 mJ/sr without having to tolerate increased electrode wear.

The invention will be explained more fully in the following with reference to embodiment examples.

DESCRIPTION OF THE PREFERRED EMBODIMENTS

Figure 1:
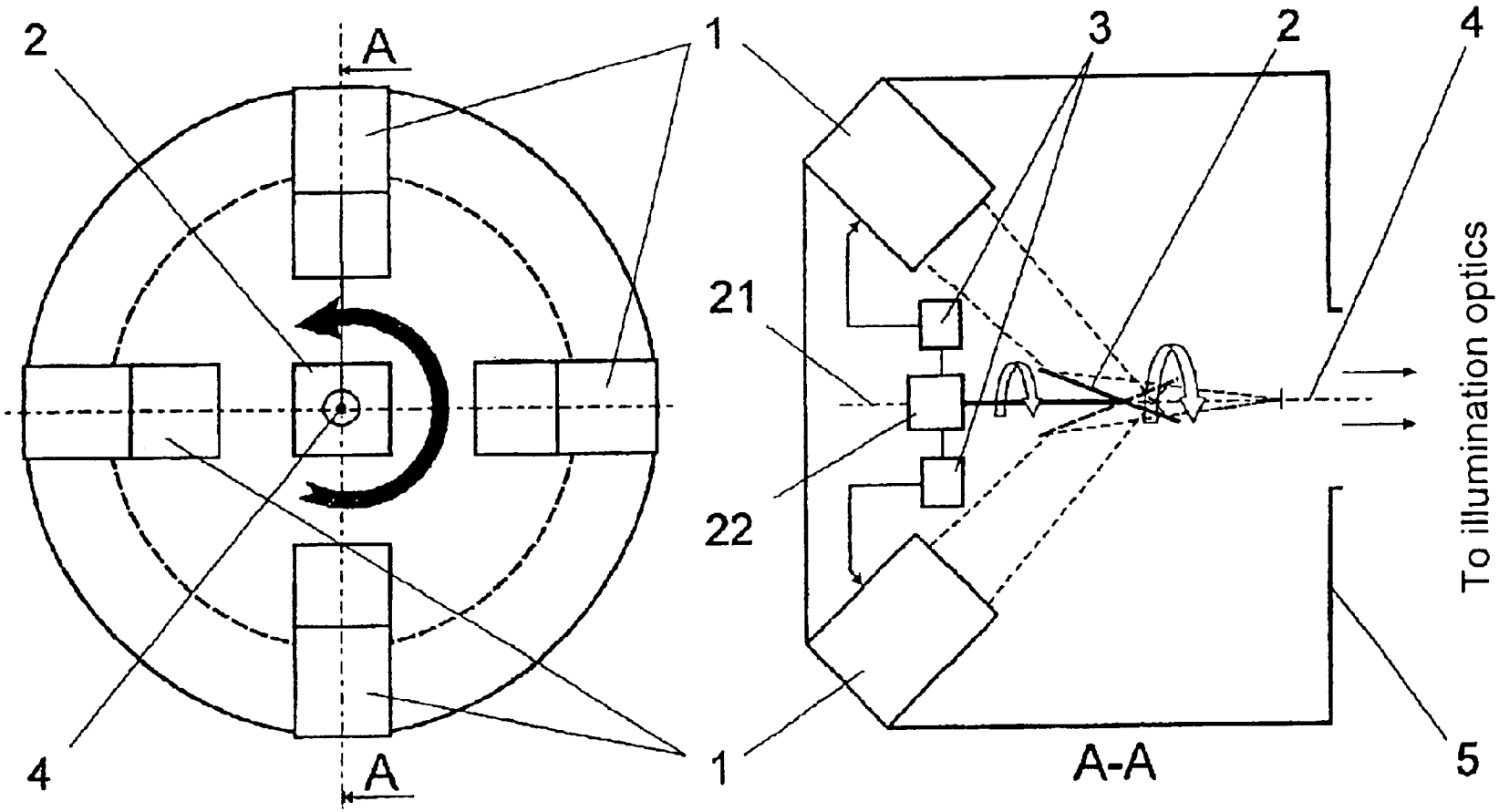
FIG. 1 is a schematic view of the invention with four individual source modules.

In a basic variant such as is shown in FIG. 1, the arrangement according to the invention has a plurality of source modules 1 (four in the present case), each of which generates EUV radiation independently and in any desired conventional manner (pinch arrangement or plasma focus arrangement triggered by z-pinch, theta-pinch or hollow cathode). Each of these source modules 1 works with a pulse repetition frequency (repetition rate) of 1500 Hz, for example. At this repetition rate, the surface temperature, at about 1500 K in continuous operation, is substantially below the melting temperature of tungsten at which the electrode surfaces are conventionally coated (e.g., 5 mm thick).

The optical beam paths of all of the source modules 1 are directed to a rotating reflector device 2 in such a way that the bundled EUV radiation of the individual source modules 1 is deflected on a common optical axis 4 of the entire arrangement in uniform succession with respect to time. This advantageously takes place with grazing incidence reflection as is indicated in the sectional drawing on the right-hand side of FIG. 1. As is shown in a top view on the left-hand side of FIG. 1, the rotating reflector device 2 is located inside a vacuum chamber 5 in which the source modules 1 are arranged and integrated in a suitably rotationally symmetric manner and so as to be uniformly distributed and rotates in an arrangement with four source modules 1, e.g., at 1500 RPS (which at the same time corresponds to the repetition rate of every source module 1) around an axis of rotation 21 coinciding with the common optical axis 4. Bundled radiation is reflected successively from the individual source modules 1 by the rotational movement of the reflector device 2 and is directed to the illumination optics (not shown) which are arranged downstream for the technical application.

To ensure the required rotational speeds (90,000 RPM in the selected example), the rotating reflector device 2 is outfitted with a balanced, magnet-mounted rotating mechanism 22 as is known in principle, e.g., from ultracentrifuges or rotating mirror arrangements for Q-switches of lasers; rotational speeds of up to several hundred thousand revolutions can currently be realized in a technically precise manner.

The synchronized triggering of the individual source modules 1 can be detected by direct acquisition of the rotational position of the rotating reflector device 2 by means of a synchronization device 3. The latter initiates the triggering of a gas discharge for generating plasma and radiation in the respective source module 1 corresponding to the position of the reflector device 2 in which a guide beam proceeding from the source module 1 would be reflected in the direction of the optical axis 4 by the reflector device 2.

Due to the continuous rotation of the reflector device 2, all four source modules 1 are triggered successively and deliver the desired EUV radiation with a repetition rate of 6 kHz at a pulse repetition frequency of 1500 Hz of the individual source modules 1 due to their uniform distribution around the axis of rotation 21 at the output of the vacuum chamber 5 in the direction of the common optical axis 4. This means that higher pulse repetition frequencies (>5 kHz) such as are required in the semiconductor industry at high average radiation outputs can easily be achieved without having to tolerate melting of the electrode material and, accordingly, increased electrode wear in quasi-continuous operation.

Figure 2:
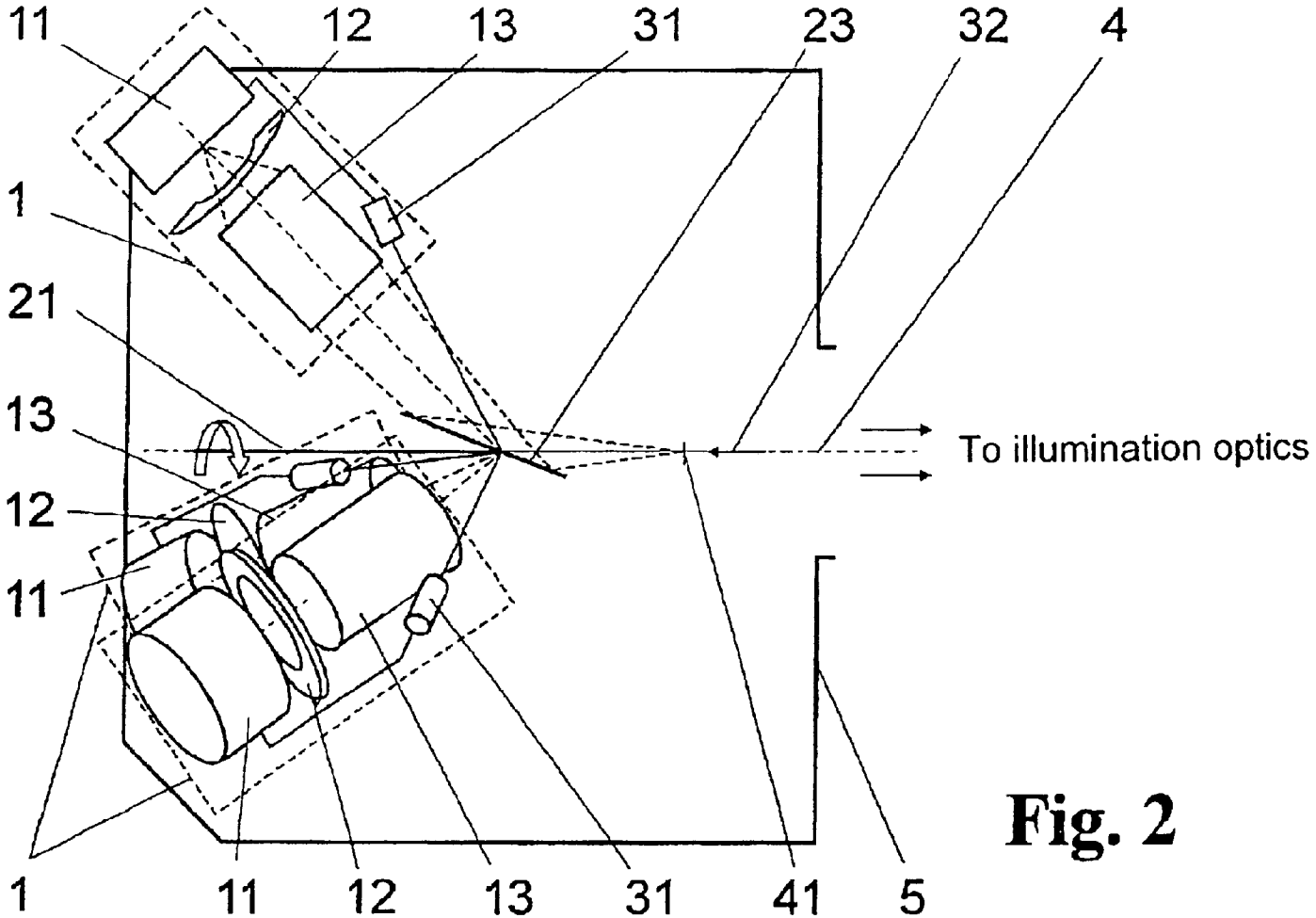
FIG. 2 shows a design variant of the invention with a plane rotating mirror and three source modules.
Figure 3A:
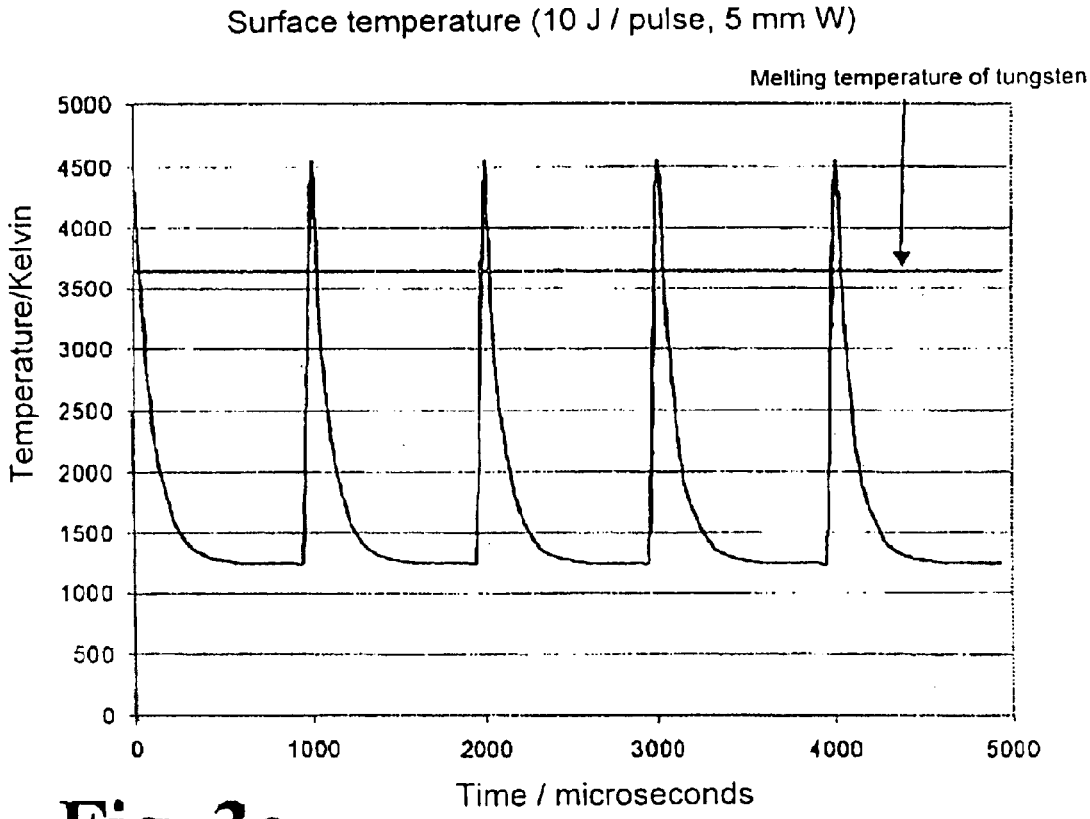
FIG. 3*a* shows a temperature curve of the electrode surface with pulse-shaped electrical excitation.
Figure 3B:
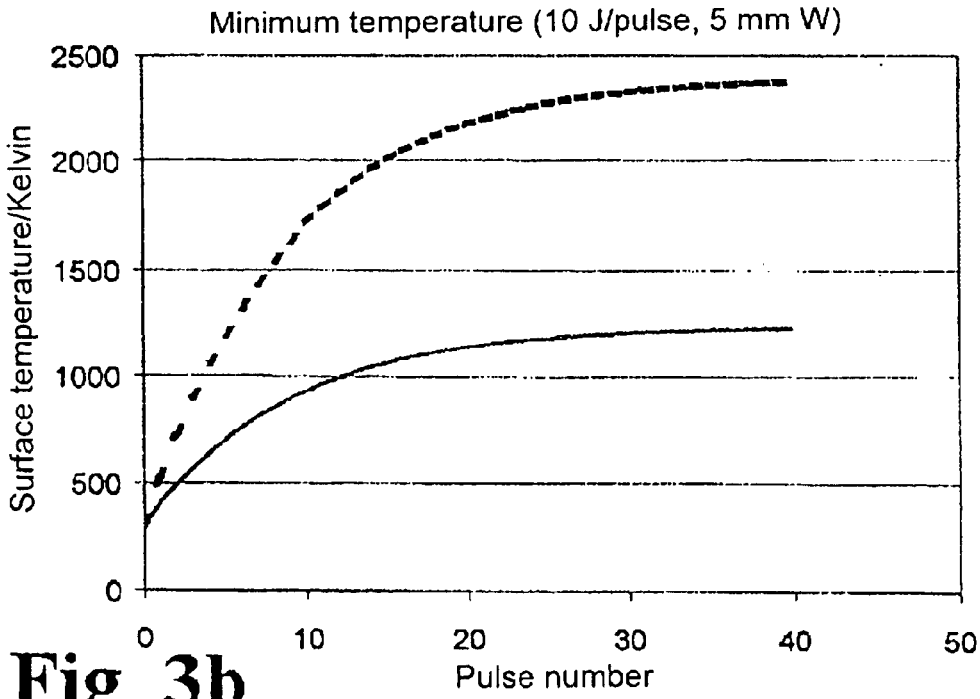
FIG. 3*b* shows the minimum temperature on the electrode surface for pulse repetition rates of 1 kHz and 2 kHz.

In another variant, as is shown in FIG. 2, the arrangement according to the invention has three source modules 1, each of which comprises an EUV source 11, a debris filter 12 and collector optics 13 and generates EUV radiation independently in a conventional manner. Each of these sources 11 works with a pulse repetition frequency (repetition rate) of 2 kHz, for example, so that a resulting repetition rate of 6 kHz is reached. At this high individual repetition rate, the surface temperature in continuous operation is already considerably higher (than in the first example according to FIG. 1 or the preferred variants according to FIG. 4), but is still appreciably below the melting temperature of tungsten as can be seen from a comparison of FIGS. 3*a* and 3*b*. FIG. 3*a* shows the time curve of the surface temperature for a quasi-continuous pulse sequence at 10 J input power at a repetition frequency of 1 kHz for an electrode coated with 5 mm tungsten. FIG. 3*b* shows the dependence of the temperature for repetition rates of 1 kHz (solid line) and 2 kHz (dashed line), so that a pulse repetition frequency of 2 kHz still seems reasonable for the indicated parameters, although a saturation of this temperature curve in long pulse sequences first occurs at higher pulse numbers.

A plane mirror 23 which rotates on the axis of rotation 21 is used as a rotating reflector device 2 in this case. The mirror 23 can be coated e.g. with rhodium, palladium or molybdenum if the mirror used for grazing incidence reflection or can be coated with a multilayer system (usually Mo/Si layers) if the mirror 23 is used for nearly normal incidence.

The synchronized triggering of the individual source modules 1 is carried out in this example by optical detection of the rotational position of the mirror 23 in a particularly precise manner by means of a position-sensitive detector 31 and a laser beam 32. The laser beam 32 is advisably reflected at the reflecting element of the rotating reflector device 2 which also couples in the EUV radiation from the source modules 1 in the direction of the optical axis 4, namely, the mirror 23. For this purpose it is sufficient to couple in one laser beam 32 as pilot laser beam along the optical axis 4, so that it is deflected via the rotating reflector device 2 in the direction of the individual source modules 1 successively with respect to time. Three position-sensitive detectors 31 are positioned in such a way relative to the three source modules 1 that the source triggering or EUV radiation emission is triggered at the correct time of the rotational position of the mirror 23. When the angular position of the rotating mirror 23 corresponding to one of the source modules 1 is reached, the detector 31 associated with this source module 1 is struck by the reflected laser beam 32 and initiates the triggering of the gas discharge generating the EUV radiation of this source module 1. The triggering accuracy (trigger jitter) given by the transit time variations in the electronic chain from the detector 31 over the trigger circuit and the rise time of the electric charge voltage until the gas discharge of the individual EUV source 11 determines the spatial fluctuations of the source image in the intermediate focus 41 which, for purposes of further imaging, is advisably located in the light path after the mirror 23 and before the imaging optics for the application.

The EUV sources 11 are the actual discharge units for plasma generation. Each of these EUV sources 11 generally contains its own electric high-voltage charging circuit (not shown explicitly in FIG. 2). In this example, the position-sensitive detector 31 is integrated directly in the source module 1 and initiates the triggering of the source 11 associated with it. However, since the triggering of the gas discharge of the individual sources 11 is carried out successively in time, one high-voltage charging circuit is actually sufficient for all source modules 1 in this example also, as is described in the following with reference to FIG. 4.

Figure 4:
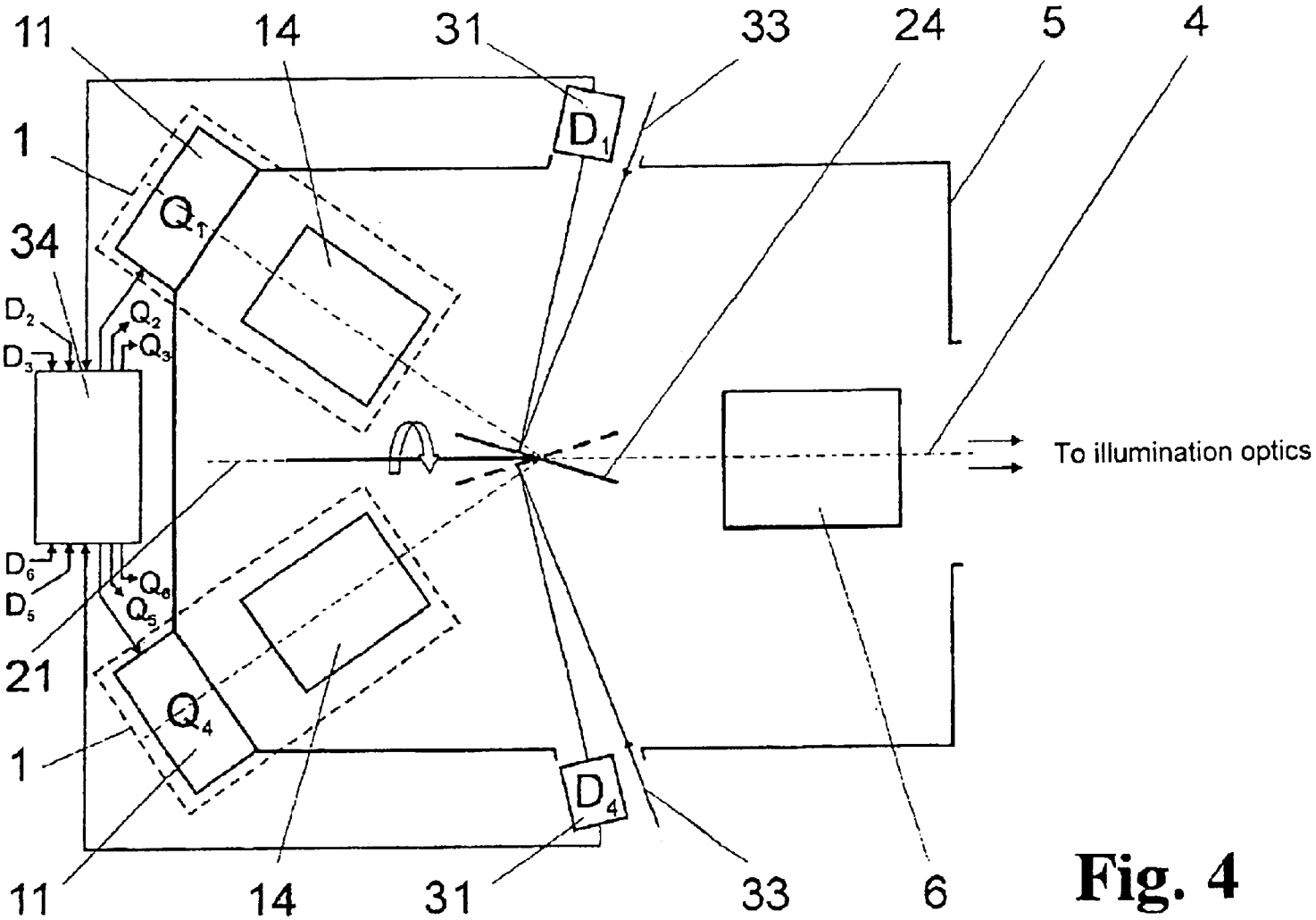
FIG. 4 shows a preferred construction of the invention with rotating grating and six source modules.

Another embodiment example corresponding to FIG. 4 is designed in such a way that six sources 11 and six optics units 14 containing a debris filter and collecting optics form six source modules 1; but only the source modules 1 which are located opposite one another in a sectional plane through the optical axis 4 are shown. The remaining four source modules 1 are arranged so as to be uniformly distributed around a circle penetrating the drawing plane perpendicularly and mirror-symmetrically.

The radiation from the source modules 1 which is bundled by means of the optics units 14 is directed to a rotating optical grating 24 in this case. As is described with reference to FIG. 1, the grating 24 which is arranged on a magnet-mounted rotating mechanism 22 (not shown in FIG. 4) on an axis of rotation 21 reflects the radiation into subsequent collector optics 6 which are provided only once on a common optical axis 4. These collector optics 6, which reduce the requirements for optics units 14 in the source modules 1 to the status of debris filters and auxiliary optics for beam bundling, thereby lowering cost, are arranged in the optical beam path between the rotating grating 24 and subsequent illumination optics for the application. The grating 24 that is used is advisably a type of reflection grating which is commonly used as an EUV bandpass filter for achieving spectral purity (spectral purity filter) (e.g., in the wavelength region between 5 nm and 20 nm). The use of the grating 24 for realizing the reflector device 2 accordingly has the advantage that the grating 24, in addition to its very good reflection characteristics, also acts as a spectral filter for reducing the so-called "out-of-band" radiation.

For every source module 1, synchronization is taken over by a separate pair comprising laser beam 33 and position-sensitive detector 31 which are coupled into the vacuum chamber through a side window. The laser beams 33 are preferably economically provided by laser diodes so that no considerable cost is incurred by the plurality of laser beams 33. For purposes of illustration, the detectors 31 shown in the drawing are designated in FIG. 4 by $D_1$ and $D_4$ in order to show the arrangement around the optical axis 4 and to facilitate the assignment for triggering the high-voltage charging module 34.

As was already mentioned above, it is possible because of the successive triggering of the gas discharge in the individual source modules 1 to carry out the high-voltage charging centrally. For this purpose, an individual high-voltage charging module 34 is provided according to FIG. 4. This high-voltage charging module 34 communicates with all source modules 1 and charges only the respective EUV source 11 corresponding to the rotational position of the grating 24 by means of assigned triggering by a synchronization device 3 (i.e., one of the detectors 31 with associated laser beam 33). A trigger input signal is provided for the high-voltage charging module 34 through the indicated lines of the detectors 31; $D_1$ and $D_4$ lie in the drawing plane, $D_2$ and $D_3$ lie above the drawing plane, and $D_5$ and $D_6$ lie below the drawing plane. The latter initiates the voltage charge and opens the corresponding lines to the EUV sources 11, designated by $Q_1$ to $Q_6$, so that the gas discharge and, therefore, a radiation pulse are triggered depending on the rotational position of the grating 24 detected by the detector 31 for the associated source 11.

FIG. 4 shows a concrete situation in which the detector 31 designated by $D_1$ delivers a signal to the high-voltage charging module 34, since the grating 24 (shown as a solid diagonal line relative to the axis of rotation 21). The high-voltage charging module 34 accordingly generates the charge voltage and releases it for the source module 1, designated by $Q_1$, whose radiation accordingly strikes the grating 24 and deflects the desired bandwidth of EUV radiation ("in band" radiation) into the collector optics 6 on the optical axis 4 by way of the filter effect of the grating 24. Following FIG. 4, this applies analogously for the $D_4$ detector 31 for triggering the source 11, designated by $Q_4$, for the position of the grating 24 shown in dashed lines.

In this example, each of the six EUV sources 11 works with a pulse repetition frequency (repetition rate) of 1 kHz. At this repetition rate, the surface temperature in continuous operation is about 1300 K (<<melting temperature of tungsten) as can be seen from FIG. 3*a* for the specified boundary conditions. The saturation curve for pulse repetition frequencies of 1 kHz shown by a solid line in FIG. 3*b* shows the advantageous limiting of the electrode temperature also for long pulse sequences (quasi-continuous operation). The entire arrangement shown in the variant described above provides a repetition rate of 6 kHz for the user.

While the foregoing description and drawings represent the present invention, it will be obvious to those skilled in the art that various changes may be made therein without departing from the true spirit and scope of the present invention.

REFERENCE NUMBERS

| | |
|---|---|
| 1 | source module |
| 11 | EUV source |
| 12 | debris filter |
| 13 | collector optics |
| 14 | optics units |
| 2 | rotating reflector device |
| 21 | axis of rotation |
| 22 | rotating mechanism |
| 23 | mirror |
| 24 | grating |
| 3 | synchronization device |
| 31 | detector |
| 32 | central laser beam |
| 33 | laser beams |
| 34 | high-voltage charging module |
| 4 | optical axis |
| 41 | intermediate focus |
| 5 | vacuum chamber |
| 6 | common collector optics |

What is claimed is:

1. An arrangement for generating EUV radiation based on gas discharged produced plasma comprising:

a vacuum chamber provided for the generation of radiation, said vacuum chamber having an axis of symmetry representing an optical axis for the generated EUV radiation upon exiting the vacuum chamber;

a plurality of source modules of identical construction, each of which generating a radiation-emitting plasma and having bundled EUV radiation, said source modules being arranged so as to be uniformly distributed around the optical axis in order to provide successive radiation pulses;

bundled beams of the individual source modules having beam axes which intersect at a point on the optical axis;

a reflector device being provided which is supported so as to be rotatable around the optical axis and which deflects the bundled radiation delivered by the source modules in the direction of the optical axis successively with respect to time; and a synchronization device being provided for circularly successive triggering of the source modules depending upon the actual rotational position of the reflector device and upon the pulse repetition frequency which is preselected by means of the rotating speed.

2. The arrangement according to claim 1, wherein the reflector device has a plane mirror as rotating reflecting optical component.

3. The arrangement according to claim 1, wherein the reflector device has an optical grating as rotating reflecting optical component.

4. The arrangement according to claim 1, wherein the optical grating is spectrally selective for the desired bandwidth of the EUV radiation that can be transmitted by subsequent optics.

5. The arrangement according to claim 1, wherein the rotating reflector device is cooled in a suitable manner.

6. The arrangement according to claim 1, wherein the individual source modules have separate high-voltage charging circuits.

7. The arrangement according to claim 1, wherein the individual source modules have a common high-voltage charging module which is triggered by the synchronization device and successively triggers the gas discharge in the individual source modules.

8. The arrangement according to claim 1, wherein the synchronization device is coupled directly with the rotating mechanism.

9. The arrangement according to claim 1, wherein the synchronization device has a position-sensitive detector which is struck by a laser beam reflected by the reflector device when reaching a rotational position of the reflector device suitable to start the gas discharge of an individual source module in time.

10. The arrangement according to claim 9, wherein the synchronization device comprises a laser beam which is coupled in in the direction of the optical axis in the direction opposite to the generated EUV radiation and is reflected at the reflector device and, for each source module, triggers an associated detector which initiates the gas discharge for the associated source module.

11. The arrangement according to claim 9, wherein the synchronization device has, for each source module, an associated laser beam and a position-sensitive detector.

12. The arrangement according to claim 1, wherein the source modules comprise an EUV source, debris filter and collector optics.

13. The arrangement according to claim 12, wherein the source modules contain an EUV source with accompanying high-voltage charging circuit.

14. The arrangement according to claim 12, wherein all source modules share a common high-voltage charging module which successively triggers the gas discharge depending upon the triggering derived from the rotational position of the reflector device.

15. The arrangement according to claim 1, wherein the source modules each comprise an EUV source and an optics unit outfitted with a debris filter and collecting optics, wherein collector optics which are shared by all of the source modules is arranged downstream of the reflector device on the optical axis.

16. The arrangement according to claim 1, wherein the quantity of source modules that is provided is such that the pulse repetition frequency of each individual source module resulting with successive control of the source modules is not higher than 1500 Hz.

* * * * *